US012214468B2

(12) United States Patent
Wu et al.

(10) Patent No.: US 12,214,468 B2
(45) Date of Patent: Feb. 4, 2025

(54) TEMPERATURE CONTROL OF CHEMICAL MECHANICAL POLISHING

(71) Applicant: Applied Materials, Inc., Santa Clara, CA (US)

(72) Inventors: Haosheng Wu, San Jose, CA (US); Hari Soundararajan, Sunnyvale, CA (US); Yen-Chu Yang, Santa Clara, CA (US); Jianshe Tang, San Jose, CA (US); Shou-Sung Chang, Mountain View, CA (US); Shih-Haur Shen, Sunnyvale, CA (US); Taketo Sekine, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 657 days.

(21) Appl. No.: 16/189,968

(22) Filed: Nov. 13, 2018

(65) Prior Publication Data

US 2019/0143476 A1 May 16, 2019

Related U.S. Application Data

(60) Provisional application No. 62/586,086, filed on Nov. 14, 2017.

(51) Int. Cl.
*B24B 49/14* (2006.01)
*B24B 37/015* (2012.01)
(Continued)

(52) U.S. Cl.
CPC ..... *B24B 37/015* (2013.01); *B24B 37/107* (2013.01); *B24B 49/02* (2013.01);
(Continued)

(58) Field of Classification Search
CPC ..... B24B 37/015; B24B 37/10; B24B 37/107; B24B 49/14; B24B 55/02
(Continued)

(56) References Cited

U.S. PATENT DOCUMENTS 4,450,652 A 5/1984 Walsh
5,196,353 A 3/1993 Sandhu et al.
(Continued)

FOREIGN PATENT DOCUMENTS

CN 102601719 7/2012
CN 104698875 6/2015
(Continued)

OTHER PUBLICATIONS

International Search Report and Written Opinion in International Application No. PCT/US2018/060809, mailed on Mar. 5, 2019, 13 pages.
(Continued)

*Primary Examiner* — Eileen P Morgan
(74) *Attorney, Agent, or Firm* — Fish & Richardson P.C.

(57) ABSTRACT

A chemical mechanical polishing system includes a support to hold a polishing pad, a carrier head to hold a substrate against the polishing pad during a polishing process, an in-situ monitoring system configured to generate a signal indicative of an amount of material on the substrate, a temperature control system to control a temperature of the polishing process, and a controller coupled to the in-situ monitoring system and the temperature control system. The controller is configured to cause the temperature control system to vary the temperature of the polishing process in response to the signal.

11 Claims, 2 Drawing Sheets

(51) Int. Cl.

| | |
|---|---|
| ***B24B 37/10*** | (2012.01) |
| ***B24B 49/02*** | (2006.01) |
| ***B24B 49/04*** | (2006.01) |
| ***B24B 55/02*** | (2006.01) |
| *B24B 57/02* | (2006.01) |

(52) U.S. Cl.
CPC ..... *B24B 49/04* (2013.01); *B24B 55/02* (2013.01); *B24B 49/14* (2013.01); *B24B 57/02* (2013.01)

(58) Field of Classification Search
USPC ..... 451/7, 41, 53, 285, 449
See application file for complete search history.

(56) References Cited

U.S. PATENT DOCUMENTS 5,597,442 A 1/1997 Chen et al.
5,643,050 A * 7/1997 Chen ..... B24B 37/015 451/6
5,722,875 A * 3/1998 Iwashita ..... B24B 49/02 451/8
5,762,544 A * 6/1998 Zuniga ..... B24B 37/30 451/285
5,851,135 A * 12/1998 Sandhu ..... G05B 19/404 451/5
5,851,846 A 12/1998 Matsui et al.
5,873,769 A 2/1999 Chiou et al.
5,957,750 A 9/1999 Brunelli
6,000,997 A 12/1999 Kao et al.
6,077,783 A * 6/2000 Allman ..... B24B 37/042 257/E21.304
6,095,898 A 8/2000 Hennofer et al.
6,121,144 A 9/2000 Marcyk et al.
6,257,954 B1 7/2001 Ng et al.
6,257,955 B1 7/2001 Springer et al.
6,264,789 B1 7/2001 Pandey et al.
6,315,635 B1 11/2001 Lin
6,461,980 B1 10/2002 Cheung et al.
6,494,765 B2 * 12/2002 Gitis ..... B24B 37/013 451/287
6,524,165 B1 * 2/2003 Wiswesser ..... B24B 37/04 451/288
6,562,185 B2 * 5/2003 Avanzino ..... B24B 37/015 156/345.13
6,640,151 B1 10/2003 Somekh et al.
6,647,309 B1 11/2003 Bone
6,829,559 B2 12/2004 Bultman et al.
7,008,295 B2 3/2006 Wiswesser et al.
7,016,750 B2 3/2006 Steinkirchner et al.
7,196,782 B2 3/2007 Fielden et al.
8,845,391 B2 9/2014 Sone et al.
9,067,296 B2 * 6/2015 Ono ..... B24B 37/105
9,636,797 B2 5/2017 Xu et al.
9,782,870 B2 * 10/2017 Maruyama ..... B24B 37/015
10,058,975 B2 8/2018 Brown
10,923,496 B2 2/2021 Mushiga et al.
2003/0055526 A1 * 3/2003 Avanzino ..... B24B 37/015 700/164
2003/0186623 A1 * 10/2003 Pham ..... B24B 21/10 451/7
2007/0135020 A1 * 6/2007 Nabeya ..... B24B 37/015 451/7
2007/0238395 A1 10/2007 Kimura et al.
2010/0081360 A1 4/2010 Xu et al.
2010/0279435 A1 * 11/2010 Xu ..... B24B 55/02 438/5
2012/0034846 A1 * 2/2012 Minamihaba ..... B24B 37/042 451/7
2012/0190273 A1 * 7/2012 Ono ..... B24B 37/015 451/5
2013/0337723 A1 * 12/2013 Tanimoto ..... B24B 49/14 451/6
2015/0079881 A1 * 3/2015 Maruyama ..... B24B 55/02 451/53
2015/0224623 A1 * 8/2015 Xu ..... B24B 49/105 451/5
2018/0236631 A1 8/2018 Eto et al.

FOREIGN PATENT DOCUMENTS

| | | |
|---|---|---|
| CN | 106062933 | 10/2016 |
| EP | 1052060 | 11/2001 |
| EP | 1165288 | 5/2003 |
| JP | 11-033897 | 2/1999 |
| JP | 2000-353681 | 12/2000 |
| JP | 2004-306173 | 11/2004 |
| JP | 2005-311246 | 11/2005 |
| JP | 2006-062047 | 3/2006 |
| JP | 2012-525715 | 10/2012 |
| JP | 2013-098183 | 5/2013 |
| JP | 2017-506438 | 3/2017 |
| KR | 10-2000-0077147 | 12/2000 |
| TW | 458849 | 10/2001 |
| TW | 201733736 | 10/2017 |
| WO | WO 2017/139079 | 8/2017 |

OTHER PUBLICATIONS

Office Action in Japanese Appln. No. 2020-526124, dated Aug. 31, 2021, 6 pages (with English translation).
Office Action in Korean Appln. No. 10-2020-7016951, dated Oct. 7, 2021, 8 pages (with English translation).
Office Action in Taiwanese Appln. No. 107139996, dated Aug. 15, 2022, 48 pages (with machine translation and English Search Report).
Ju et al., "Effect of slurries on chemical mechanical polishing of decorative glasses by fixed-abrasive pad," Optics and Precision Engineering, Apr. 30, 2013, 21(4):955-962(abstract only).
Office Action in Chinese Appln. No. 201880063359.X, dated Feb. 19, 2023, 12 pages.

* cited by examiner

TEMPERATURE CONTROL OF CHEMICAL MECHANICAL POLISHING

CROSS-REFERENCE TO RELATED APPLICATIONS

This application claims priority to U.S. Application Ser. No. 62/586,086, filed on Nov. 14, 2017, the entire disclosure of which is incorporated by reference.

TECHNICAL FIELD

This invention relates to methods and apparatus for temperature control of chemical mechanical polishing (CMP).

BACKGROUND

Integrated circuits are typically formed on substrates, such as silicon wafers, by the sequential deposition of various layers such as conductive, semiconductor or insulating layers. After a layer is deposited, a photoresist coating can be applied on top of the layer. A photolithographic apparatus, which operates by focusing a light image on the coating, can be used to remove portions of the coating, leaving the photoresist coating on areas where circuitry features are to be formed. The substrate can then be etched to remove the uncoated portions of the layer, leaving the desired circuitry features.

As a series of layers are sequentially deposited and etched, the outer or uppermost surface of the substrate tends to become increasingly non-planar. This non-planar surface presents problems in the photolithographic steps of the integrated circuit fabrication process. For example, the ability to focus the light image on the photoresist layer using the photolithographic apparatus may be impaired if the maximum height difference between the peaks and valleys of the non-planar surface exceeds the depth of focus of the apparatus. Therefore, there is a need to periodically planarize the substrate surface.

Chemical mechanical polishing (CMP) is one accepted method of planarization. Chemical mechanical polishing typically includes mechanically abrading the substrate in a slurry that contains a chemically reactive agent. During polishing, the substrate is typically held against a polishing pad by a carrier head. The polishing pad may rotate. The carrier head may also rotate and move the substrate relative to the polishing pad. As a result of the motion between the carrier head and the polishing pad, chemicals, which can include a chemical solution or chemical slurry, planarize the non-planar substrate surface by chemical mechanical polishing.

SUMMARY

In one aspect, a chemical mechanical polishing system includes a support to hold a polishing pad, a carrier head to hold a substrate against the polishing pad during a polishing process, an in-situ monitoring system configured to generate a signal that depends on an amount of material on the substrate, a temperature control system to control a temperature of the polishing process, and a controller coupled to the in-situ monitoring system and the temperature control system. The controller is configured to cause the temperature control system to vary the temperature of the polishing process in response to the signal.

Implementations may include one or more of the following features.

The temperature control system may include an infrared heater to direct heat onto the polishing pad, a resistive heater in the support or carrier head, a thermoelectric heater or cooler in the support or carrier head, a heat exchanger configured to exchange heat with a polishing liquid before the polishing liquid is delivered to the polishing pad, or a heat exchanger having a fluid passage in the support.

The in-situ monitoring system may be configured to detect exposure of an underlying layer during the polishing process, and the controller may be configured to change the temperature of the polishing process in response to detecting exposure of the underlying layer. The function may be a step function that is discontinuous upon changes of exposure of the underlying layer of substrate.

The in-situ monitoring system may be configured to generate a signal having a value representative of a thickness of a layer or of an amount removed during the polishing process, and the controller may be configured to vary the temperature of the polishing process in response to the signal. The value of the signal may be proportional to the thickness of the layer or the amount removed. The function may be a continuous function of the thickness of the layer of the substrate. The controller may be configured to cause the temperature control system to change, e.g., increase or decrease, the temperature of the polishing process in response to the value of the signal crossing a threshold. The value of the signal crossing the threshold may indicate that a remaining thickness of the layer has fallen below a threshold thickness, and the controller may be configured to reduce the temperature, e.g., by at least 10° C., in response to the remaining thickness of the layer falling below the threshold thickness. The controller may be configured to adjust the temperature by an amount sufficient to achieve a target polishing characteristic.

A sensor may monitor the temperature of the polishing process, and the controller may receive a signal from the sensor, and the controller may include a closed-loop control of the temperature control system to drive a measured temperature from the sensor to the desired temperature.

The in-situ monitoring system may include an optical monitoring system, eddy current monitoring system, a friction sensor, a motor current or motor torque monitoring system or a temperature sensor.

In another aspect, a method of chemical mechanical polishing includes holding a substrate against a polishing pad, monitoring an amount of material on the substrate with an in-situ monitoring system during polishing of the substrate and generating a signal indicative of the amount of material, and causing a temperature control system to vary a temperature of the polishing process in response to the signal.

Implementations may include one or more of the following features.

Causing the temperature control system to vary the temperature may include one or more of directing heat from an infrared heater onto the polishing pad, supplying power to a resistive heater in a platen supporting the polishing pad, heating a polishing liquid, or heating a rinsing liquid.

Data may be stored indicating a desired temperature of polishing process as a function of the thickness of the substrate. The in-situ monitoring system may be configured to detect exposure of an underlying layer during the polishing process, and the function may be a step function triggered by exposure of the underlying layer of substrate. The in-situ monitoring system may generate a value representative of a thickness of a layer being polishing during the polishing process, and the function may be a continuous function of the thickness of the layer.

A potential advantage of the chemical mechanical polishing apparatus described herein is that it can control or limit dishing and erosion of the material on a substrate during a polishing operation. An amount of dishing and erosion can be more consistent from one polishing operation to the next, and wafer-to-wafer non-uniformity (WTWNU) can be decreased. The repeatability of the polishing process can be improved. Throughput can be maintained or increased during a bulk polishing operation.

The details of one or more embodiments are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

The overall efficacy of a CM' process can depend on the material being polished as well as the temperature of the polishing process, e.g., the temperature at the surface of a polishing pad and/or the temperature of the polishing liquid and/or the temperature of the wafer. For some polishing processes, e.g., bulk polishing of metal, a higher temperature can provide a higher polishing rate, and is thus desirable to provide higher throughput. Without being limited to any particular theory, this may be because the higher temperature increases the reactivity of the chemistry.

On the other hand, for some polishing processes, e.g., processes in which underlying layer—for example a barrier, liner or oxide layer—is exposed, a lower temperature can improve topography, e.g., dishing or erosion, and/or polishing uniformity. Examples of such processes include metal clearing, barrier layer removal, and overpolishing. Again without being limited to any particular theory, this may be because the lower temperature results in lower selectivity in the polishing process.

However, throughput can be maintained or increased while controlling or mitigating CMP effects such as erosion and dishing by modulating the temperature of the CMP process in response to a signal indicative of an amount of material on the substrate.

Figure 1:
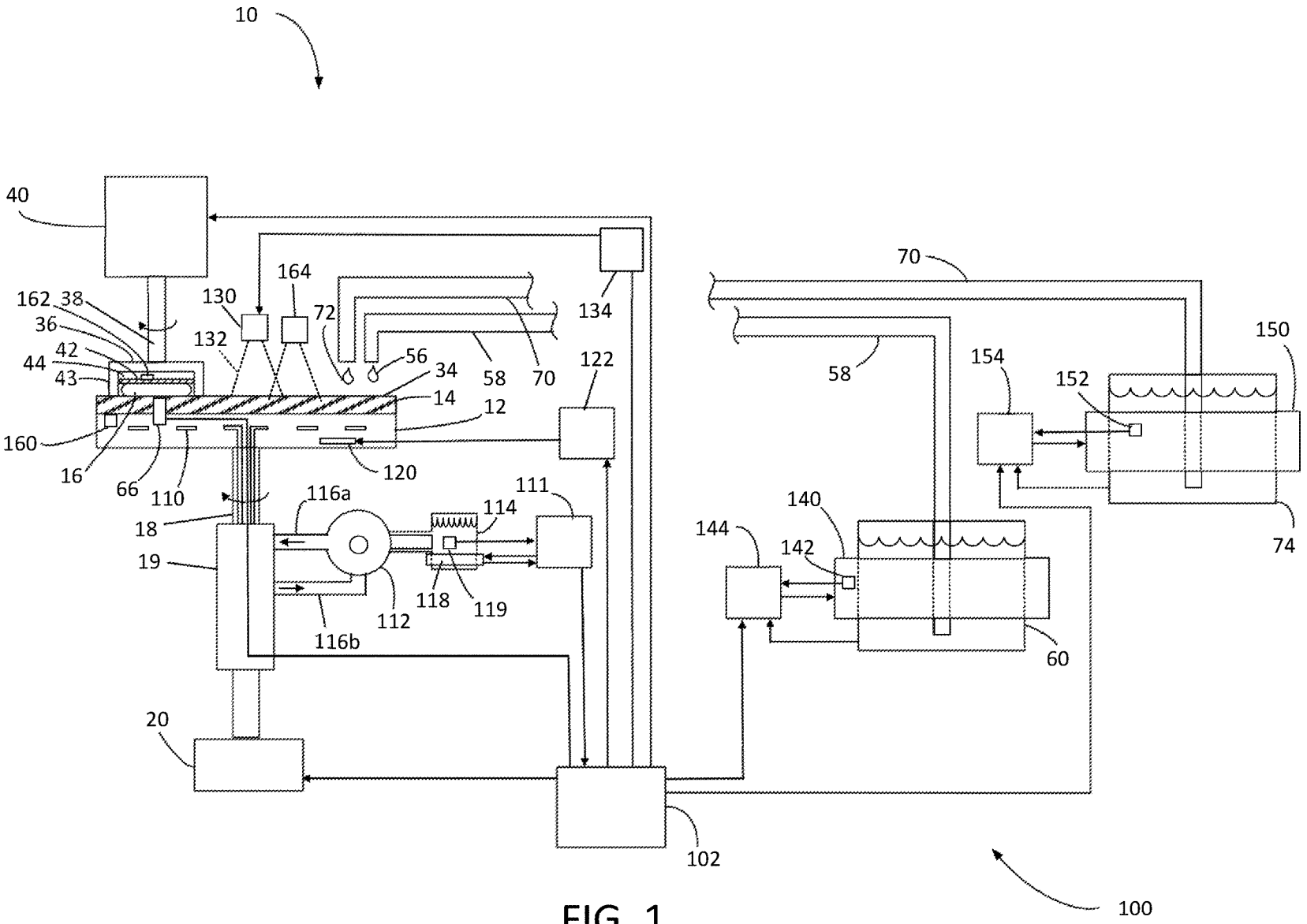
FIG. 1 is a block diagram of the main components of a chemical mechanical polishing system.

Referring to FIG. 1, a chemical mechanical polishing (CMP) apparatus 10 includes a platen 12 to support a polishing pad 14. The platen 12 is mounted on the end of a drive shaft 18 of a motor 20, which rotates the platen 12 during a polishing operation. The platen 12 may be made of a thermally conductive material, e.g., aluminum.

Typically, the polishing pad 14 is adhesively attached to the platen 12. The polishing pad 14 can be, for example, a traditional polishing pad, a fixed abrasive pad, or the like. An example of a traditional pad is an IC1000 pad (Rodel, Newark, Del.). The polishing pad 14 provides a polishing surface 34.

A carrier head 36 faces the platen 12 and holds a substrate 16 during the polishing operation. The carrier head 36 is typically mounted on the end of a drive shaft 38 of a second motor 40, which can rotate the carrier head 36 during polishing and at the same time that the platen 12 is also rotating. Various implementations may further include a translation motor that can move the carrier head 36 laterally over the polishing surface 34 of the polishing pad 14, for example, while the carrier head 36 is rotating.

The carrier head 36 can include a support assembly, e.g., a piston-like support assembly 42. The support assembly 42 can be surrounded by an annular retaining ring 43. The support assembly 42 has a substrate-receiving surface, such as a flexible membrane, inside of the central open region within the retaining ring 43. A pressurizable chamber 44 behind the support assembly 42 controls the position of the substrate-receiving surface of the support assembly 42. By adjusting the pressure within the chamber 44, the pressure with which the substrate 16 is pressed against the polishing pad 14 can be controlled. More specifically, an increase in the pressure within the chamber 44 causes the support assembly 42 to push the substrate 16 against the polishing pad 14 with greater force, and a decrease in the pressure within the chamber 44 reduces that force.

The polishing system includes polishing liquid delivery system. For example, a pump can direct polishing liquid from a supply reservoir 60 through a polishing liquid delivery tube 58, e.g., a pipe or flexible tubing, to the surface of the polishing pad 14. In some implementations, the polishing pad 14 comprises an abrasive, and the polishing liquid 56 is typically a mixture of water and chemicals that aid in the polishing process. In some implementations, the polishing pad 14 does not contain an abrasive, and the polishing liquid 56 may contain an abrasive in a chemical mixture, e.g., the polishing liquid can be a slurry. In some implementations, both the polishing pad 14 and the polishing liquid 56 can include an abrasive.

The polishing system can also include a pad rinse system, such as a delivery tube 70 that delivers a rinsing liquid, e.g., deionized water 72, from a tank 74 to the surface 34 of the polishing pad 14.

The chemical mechanical polishing apparatus 10 also includes an in-situ monitoring system 66, e.g., an eddy current monitoring system or an optical monitoring system located below the polishing surface 34. Other possibilities include a friction monitoring system to detect the friction between the substrate and the polishing pad, a motor torque or motor current monitoring system to monitor torque or current used by the motors 20 and/or 40, a chemistry sensor to monitor the chemistry of the polishing liquid, or a temperature sensor to monitor a temperature of the polishing process, e.g., a temperature of the polishing pad 14 and/or the polishing liquid and/or the wafer 16, e.g., the thermocouple 162 or infrared camera 164 discussed below. The in-situ monitoring system 66 is configured to generate a signal that depends on (and is thus indicative of) an amount of material on the substrate.

The amount of material on the substrate 16 can be represented as a binary value (i.e., that the material is either present or absent). For example, a sudden change in the signal from the friction monitoring system, motor torque or motor current monitoring system, or eddy current monitoring system or temperature monitoring system can indicate exposure of an underlying layer and that the overlying material that was being polished is now absent.

The signal can also be a value representative of, e.g., proportional to, the thickness of the material, or as a value representative, e.g., proportional to, the amount of material removed or lost, e.g., due to dishing and/or erosion of the features. For example, measurements from an eddy current monitoring system or an optical monitoring system can be converted into actual thickness measurements, or into values proportional to the thickness, or into values that represent progress through a polishing operation. In general, the signal can vary monotonically with thickness.

The chemical mechanical polishing apparatus 10 includes a temperature control system 100 to control the temperature of the polishing process. The temperature control system 100 includes a controller 102, e.g., a programmed computer or special purpose processor, that receives the signal from the in-situ monitoring system 66 and that control various components of the polishing system to control the temperature in response to the output of the in-situ monitoring system 66, as described in greater detail below.

In some implementations, the temperature control system 100 controls the temperature of the platen 12, which in turn controls the temperature of the polishing pad 14 and the substrate 16.

For example, the platen 12 can include within its interior an array of fluid circulation channels 110 through which a coolant or heating fluid can be circulated during operation. A pump 112 directs fluid into the channels 110 from a reserve tank 114 via an inlet tube 116*a* and/or draws fluid out of the circulation channels 110 and returns the fluid to the reserve tank 114 through the outlet tube 116*b*. The inlet tube 116*a* and outlet tube 116*b* can be connected to channels in the drive shaft 18, which are in turn connected to the circulation channels 110, by a rotary coupling 19.

A heating and/or cooling element 118 encircling the reserve tank 114 can heat and/or cool the fluid flowing through the circulation system, e.g., to a predetermined temperature, thereby controlling the temperature of the platen 12 during the polishing operation. For example, the heating element can include a resistive electrical heater, an infrared lamp, or a heat exchanging system which directs a heated fluid through an exchange jacket or coil at the reserve tank 114, and the like. The cooling element can include a heat exchanging system which directs a cooled fluid through an exchange jacket or coil at the reserve tank 114, a Peltier heat pump, and the like.

Alternatively or in addition, the temperature control system 100 can include a resistive heater 120 or a thermoelectric cooler, e.g., a Peltier heat pump, embedded in the platen 12. A power source 122 can adjustably deliver electric power to the resistive heater 120 or a thermoelectric cooler in the platen 12 to control the platen temperature. Power can be routed through the drive shaft 18 via the rotary coupling 19.

Alternatively or in addition, the temperature control system 100 can include an element in the carrier head to adjust the temperature of the substrate. For example, fluid circulation channels can pass through the carrier head, and hot or cold liquid can be pumped through the channels to heat and/or cool the carrier head. As another example, a resistive heater or a thermoelectric cooler, e.g., a Peltier heat pump, can be embedded in the carrier head, e.g., in the flexible membrane. Power or fluid can be routed through the drive shaft 38.

In some implementations, the temperature control system 100 includes a heating or cooling element to directly heat or cool the polishing pad 14, and thus the polishing liquid 56 and the substrate 16. For example, an infrared heater 130, e.g., an infrared lamp, can be employed to heat the polishing pad 14. The infrared heater 130 can be positioned over the platen 12 to direct infrared light 132 onto the polishing pad 14.

In some implementations, the temperature control system 100 controls the temperature of the polishing liquid 56 before delivery of the polishing liquid to the surface of the polishing pad 14. For example, a heating/cooling element 140 can surround or be placed in the reservoir 60 and can be used to heat and/or cool the polishing liquid, e.g., to a desired temperature, before it is delivered to the polishing pad 14.

In some implementations, the temperature control system 100 controls the temperature of the rinsing liquid. For example, the temperature control system 100 can include a heating and/or cooling element 150 that provides heating and/or cooling of the rinsing liquid before it is delivered to the polishing pad 14. The heating and/or cooling element 150 can surround and/or be positioned in the tank 74.

In implementations in which a liquid is delivered to the platen to control the temperature, a sensor can be used to sense the temperature of the liquid before the liquid is delivered to the platen. In addition, the temperature control system 100 can include a feedback system to stabilize the temperature of the fluid.

For example, a thermal sensor 119 can be positioned in or adjacent the reserve tank 114 to monitor the temperature of the coolant or heating fluid. The temperature control system 100 can include a controller 111 that receives a signal from the sensor 119 and adjusts operation of the heating/cooling element 118 to bring the fluid to or maintain the fluid at a temperature consistent with the desired temperature received from the controller 102. Alternatively, the operations could be performed directly by the controller 102.

As another example, a thermal sensor 142 can be positioned in or adjacent the reserve tank 60. The temperature control system 100 can include a controller 144 that receives a signal from the sensor 142 to monitor the temperature of the polishing liquid. The controller 144 adjusts operation of the heating/cooling element 140 to bring the polishing liquid to or maintain the polishing liquid at a temperature consistent with the desired temperature received from the controller 102.

As another example, a thermal sensor 152 can be positioned in or adjacent the reserve tank 74. The temperature control system 100 can include a controller 154 that receives a signal from the sensor 152 to monitor the temperature of the rinsing liquid. The controller 154 is coupled to the heating/cooling element 150 and adjusts operation of the heating/cooling element 150 to bring the rinsing liquid to or maintain the rinsing liquid at a temperature consistent with the desired temperature received from the controller 102.

In addition, the controller 102 can receive measurements indicative of the temperature of the polishing process. In particular, a sensor can be positioned to monitor the temperature of the polishing liquid 56 on the polishing pad 14, and/or the temperature of the polishing pad 14 and/or the temperature of the substrate 16. For example, the sensor can include a thermocouple 160 embedded in or placed on the platen 12 to measure a temperature of the polishing pad 14, or a thermocouple 162 in the carrier head 36 to measure a temperature of the substrate 16. As another example, the sensor can include an infrared camera 164 positioned over the platen to monitor the temperature of the polishing pad 14 and/or polishing liquid 56 on the polishing pad 14.

During polishing, the carrier head 36 holds the substrate 16 against the polishing surface 34 while the motor 20 rotates the platen 12 and the motor 40 rotates the carrier head 36. The polishing liquid delivery tube 58 delivers a mixture of water and a chemical to the polishing surface 34. After polishing, debris and excess polishing liquid can be rinsed from the pad surface by a rinsing liquid, e.g., water, from the delivery tube 70.

During the polishing process, which is partially chemical in nature, the polishing rate and polishing uniformity can depend on temperature. More specifically, the polishing rate tends to increase as the temperature increases, but the polishing non-uniformity and topography non-uniformity, e.g., dishing and/or erosion, tends to decrease as the temperature increases.

The temperature control system 100 is configured to control the process temperature based on a signal from the in-situ monitoring system 66 indicative of an amount of material on the substrate. This can provide benefits of both increased polishing rate, reduced non-uniformity, and controlled surface topography, e.g., dishing and/or erosion.

Figure 2:
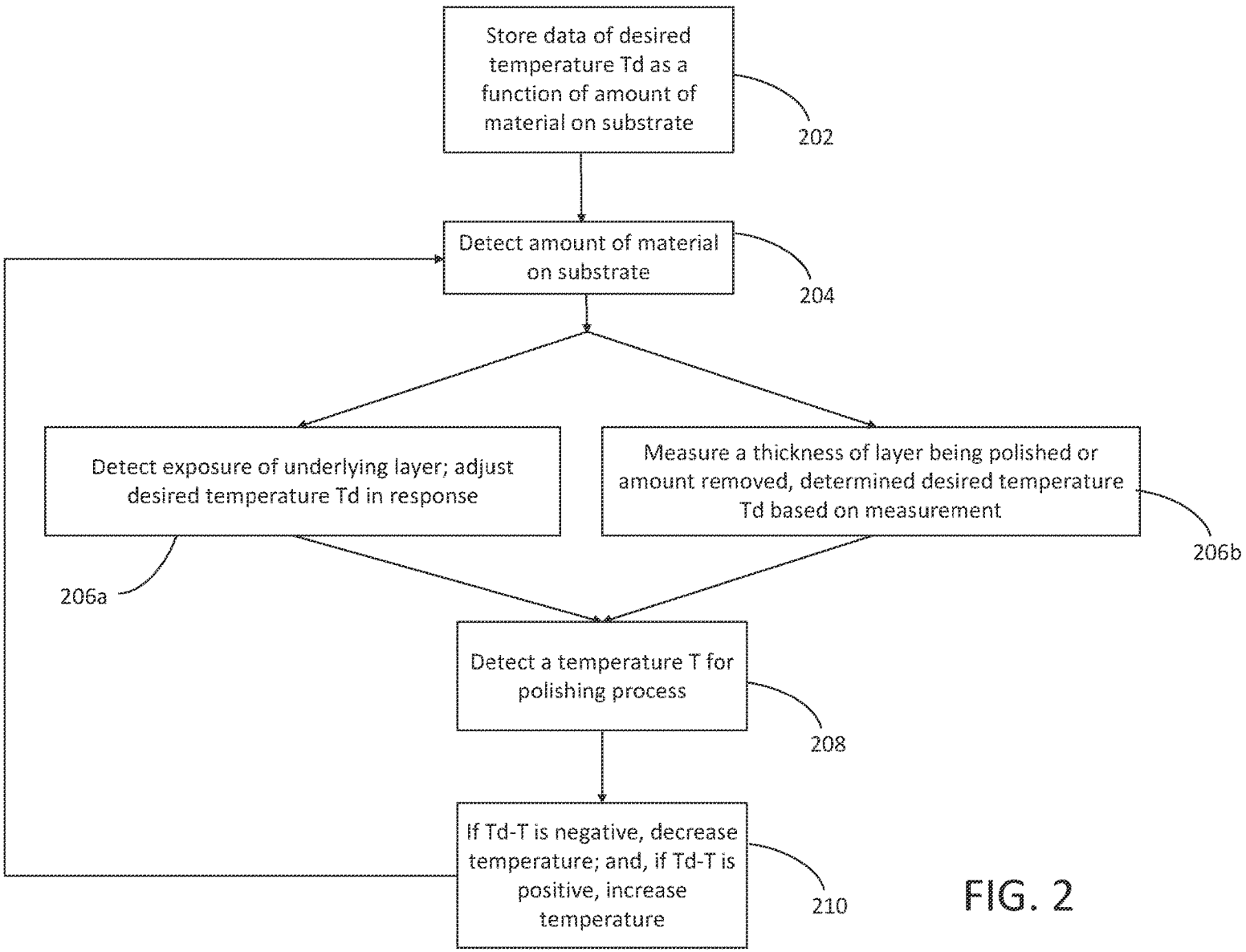
FIG. 2 is a flow chart showing operations for controlling a polishing system, such as the polishing system of FIG. 1.

In particular, the temperature control system 100 can be configured to perform the operation illustrated in FIG. 2. Referring to FIG. 2, the temperature control system 100, e.g., the controller 102 stores data indicating a desired temperature for the polishing process as a function of the signal (and thus of the amount of material on the substrate 16) (step 202). This data can be stored in a variety of formats, e.g., look-up table or a polynomial function. In some implementations, e.g., where the temperature is to change upon exposure of an underlying layer, the amount of material is indicated simply as presence or absence of a layer. In this case, the function can be a step function, e.g., a binary output depending on the presence or absence of the layer. In some implementations, e.g., where the temperature is to be reduced as polishing progresses, the amount of material is indicated as a thickness or as an amount removed. In this case, the function can be a continuous function of the thickness. This data can be set prior to polishing.

During polishing, the temperature control system 100 receives a signal that depends on the amount of material on the substrate 16 (step 204). For example, the temperature control system 100 can receive a signal from the in-situ monitoring system 66 indicative of the amount of material on the substrate 16. As noted above, the amount of material can be indicated by a binary signal that simply indicates the presence or absence of a layer, or as a thickness value, or as a value representative, e.g., proportional to the thickness or amount of material removed.

In cases where the amount of material is indicated simply as presence or absence of a layer, the controller 102 detects exposure of the underlying layer of the substrate 16 based on the signal from the sensor 66, and adjusts the desired temperature Td in response (step 206*a*).

In cases where the amount of material is indicated as a thickness, the controller 102 determines a thickness of the layer of the substrate 16 being polished from the signal from the in-situ monitoring system 66, and determines a desired temperature based on the measured thickness (step 206*b*).

The controller 102 detects the temperature of the polishing process (step 208), e.g., a temperature of the substrate 16, the polishing pad, or the polishing liquid on the polishing pad. The temperature can be measured by a sensor, such as the thermocouple 160 or infrared camera 164.

The controller 102 adjusts the temperature of the polishing process to match the desired temperature (step 210). If the temperature of the polishing process is lower than the desired temperature, the controller 102 increases the temperature. Alternatively, if the temperature of the substrate 16 is higher than the desired temperature, the controller 102 decreases the temperature.

In general, the change in temperature is sufficient to achieve a target polishing characteristic, e.g., a certain level of dishing, erosion, residue removal, material loss, polishing rate, thickness, WIWNU, etc.

It is believed that undesirable side-effects such as erosion and dishing can be limited by controlling the temperature. In some implementations, to achieve improved topography, the temperature can be reduced by at least 10° C. when the underlying layer is exposed or the layer being polished falls below a threshold thickness.

To achieve a more uniform and repeatable polishing rate, and to reduce side effects such as erosion and dishing, temperature in CMP can be controlled, particularly towards a target temperature that improves planarization, in one or more ways as follows.

Returning to FIG. 1, the temperature control system 100 can control the temperature of the polishing process by controlling the temperature of the fluid circulating through the fluid circulating channels 110. Because the platen 12 is made of a thermally conductive material, the temperature of the fluid in the channels 110 can directly and quickly influence the temperature of the polishing pad 14.

The temperature control system 100 can control the polishing temperature by adjusting the thermoelectric power delivered by the power source 122 to the resistive heater 120 in the platen 12 to control the platen temperature.

The temperature control system 100 can control the temperature of the polishing process by controlling the amount of power delivered by power source 134 to the infrared heating element 130 over the platen 12.

The temperature control system 100 can control the temperature of the polishing process by controlling the temperature of a liquid that is delivered to the polishing surface 34. Even if the temperature of the platen 12 is controlled as described above, depending on the thermal conductivity of the platen, this process may not provide as much control of the temperature of the polishing surface 34 as desired. Additional temperature control can include delivering liquid at a controlled temperature to the polishing surface 34.

For example, the controller 102 can control the polishing fluid 56, delivered through the liquid delivery tube 58. The controller 102 can set a target temperature, and the controller 144 can then adjust the power delivered to the heating/cooling element 140 to control the temperature of the polishing fluid 56, e.g., to the target temperature. As another example, the controller 102 can control the rinsing liquid 72. The controller 102 can adjust the power delivered to the heating/cooling element 150 to control the temperature of the rinsing liquid, e.g., to the target temperature.

Other embodiments are within the following claims. For example, in systems in which the coolant can be delivered to the platen 12 to modulate the temperature of the polishing surface 34, the platen 12 can be made of any appropriate thermally conducting material, besides aluminum as described above. In addition, other known techniques for measuring the amount of material on the substrate 16, e.g. an optical sensor installed in the platen 12 or embedded in the polishing pad. Furthermore, the temperature of the polishing liquid or water delivered to the polishing surface can be controlled by heating or cooling elements placed at locations in the delivery systems other than the locations described. In addition, liquid may be delivered to the polishing surfaces through multiple delivery tubes, with an independent temperature controller controlling the temperature of the liquid in each tube.

A multi-step metal polishing process, e.g., copper polishing, can include a first polishing step in which bulk polishing of the copper layer is performed at a first platen 12 with a first polishing pad 14 without temperature control but using an in-situ monitor to halt the polishing step, and a second polishing step in which the barrier layer is exposed and/or removed and using the temperature control procedure discussed above.

The controller 102 and other computing devices part of systems described herein can be implemented in digital electronic circuitry, or in computer software, firmware, or hardware. For example, the controller can include a processor to execute a computer program as stored in a computer program product, e.g., in a non-transitory machine readable storage medium. Such a computer program (also known as a program, software, software application, or code) can be written in any form of programming language, including compiled or interpreted languages, and it can be deployed in any form, including as a standalone program or as a module, component, subroutine, or other unit suitable for use in a computing environment.

A number of embodiments of the invention have been described. Nevertheless, it will be understood that various modifications may be made without departing from the spirit and scope of the invention.

What is claimed is:

1. A chemical mechanical polishing system, comprising:

a support to hold a polishing pad;

a carrier head to hold a substrate against the polishing pad during a polishing process;

an in-situ monitoring system configured to generate a signal having a value representative of a thickness of a layer on the substrate during the polishing process;

a temperature control system to control a temperature of a component selected from a surface of the polishing pad, a polishing liquid on the polishing pad, the substrate, or a combination thereof; and a controller coupled to the in-situ monitoring system and the temperature control system, the controller configured to store, prior to polishing, a continuous function that receives only the value representative of the thickness of the layer from the signal and outputs a desired temperature of the component based on the value representative of the thickness, wherein the continuous function is continuous across changes in the thickness of the layer of the substrate, and cause the temperature control system to drive the temperature of the component toward the desired temperature output by the continuous function in response to the signal such that the desired temperature and the temperature of the component vary according to the thickness of the layer.

2. The system of claim 1, wherein the value of the signal is proportional to the thickness of the layer.

3. The system of claim 1, wherein the controller is configured to cause the temperature control system to change the temperature of component in response to the value of the signal crossing a threshold.

4. The system of claim 3, wherein the value of the signal crossing the threshold indicates that a remaining thickness of the layer has fallen below a threshold thickness.

5. The system of claim 4, wherein the controller is configured to reduce the temperature in response to the remaining thickness of the layer falling below the threshold thickness.

6. The system of claim 5, wherein the controller is configured to reduce the temperature by at least 10° C.

7. The system of claim 4, wherein the controller is configured to increase the temperature in response to the remaining thickness of the layer falling below the threshold thickness.

8. The system of claim 4, wherein the controller is configured to adjust the temperature of component by an amount sufficient to achieve a target polishing characteristic.

9. The system of claim 7, further comprising a sensor to monitor the temperature of component, and wherein the controller receives a signal from the sensor, and wherein the controller comprises a closed-loop control of the temperature control system to drive a measured temperature from the sensor to the desired temperature.

10. The system of claim 1, wherein the in-situ monitoring system comprises an optical monitoring system, eddy current monitoring system, a friction sensor, a motor current or motor torque monitoring system or a temperature sensor.

11. A method of chemical mechanical polishing, comprising:

holding a substrate against a polishing pad;

monitoring a thickness of a layer of material on the substrate with an in-situ monitoring system during a polishing process of the layer on substrate and generating a signal that depends on the thickness of the layer of material, wherein the in-situ monitoring system is configured to generate a value representative of the thickness of the layer being polished during the polishing process;

storing, prior to the polishing process, a continuous function that receives only the value representative of the thickness of the layer from the signal and outputs a desired temperature of the polishing process based on the value, wherein the continuous function is continuous across changes in the thickness of the layer of the substrate; and causing a temperature control system to vary a temperature of a component selected from a surface of the polishing pad, a polishing liquid on the polishing pad, the substrate, or a combination thereof, such that a temperature of a surface of the component is adjusted according to the continuous function in response to the signal.

* * * * *